United States Patent [19]

Medovar et al.

[11] 3,981,349

[45] Sept. 21, 1976

[54] ELECTROSLAG REMELTING PLANT

[76] Inventors: Boris Izrailevich Medovar, ulitsa A.Barbjusa, 22/26, kv. 109, Kiev; Vladimir Yakovlevich Saenko, Kharkovskoe shosse, 18, kv. 71, Kiev; Grigory Bentsionovich Schupak, ulitsa Chudnovskogo, 7, kv. 61, Kiev; Jury Fedorovich Alferov, bulvar Lepse, 29, kv. 64, Kiev; Vladimir Fedorovich Karpov, prospekt Metallurgov, 213/3 kv. 18, Zhdanov Donetskoi oblasti; Kirill Adolfovich Berman, ulitsa Pirogova, 67, kv. 68, Zhdanov Donetskoi oblasti; Vitaly Vasilievich Pogoretsky, ulitsa Pushkina, 66, Zhdanov Donetskoi oblasti; Vitaly Alexandrovich Ovseichuk, perevlok Vesely, 5a, kv. 18, Korsakov Sakhalinskoi oblasti; Petr Stepanovich Zabolotsky, bulvar Shevchenko, 248, kv. 124, Zhdanov Donetskoi oblasti; Georgy Alexandrovich Boiko, ulitsa Vladimiro-Lybedskaya, 16, kv. 106, Kiev; Vladimir Ivanovich Oleinik, ulitsa Entuziastov, 29/1, kv. 38, Kiev; Stanislav Vitalievich Grodzitsky, ulitsa Matejuka, 5, kv. 190, Kiev; Viktor Andreevich Popov, ulitsa Andreevskaya 11, kv. 2, Kiev; Anatoly Ivanovich Chvertko, bulvar Lesi Ukrainki, 2, kv. 10, Kiev, all of U.S.S.R.

[22] Filed: Sept. 19, 1975

[21] Appl. No.: 615,076

[52] U.S. Cl. ..... 164/252; 164/52

[51] Int. Cl.[2] ..... B22D 27/02

[58] Field of Search ..... 164/252, 52

[56] References Cited

UNITED STATES PATENTS

| | | | |
|---|---|---|---|
| 3,587,715 | 6/1971 | Holzgruber et al. | 164/252 |
| 3,752,216 | 8/1973 | Fritsche | 164/252 |
| 3,875,992 | 4/1975 | Paton et al. | 164/252 |

*Primary Examiner*—Leonidas Vlachos

*Attorney, Agent, or Firm*—Haseltine, Lake & Waters

[57] ABSTRACT

An electroslag remelting plant according to the invention, comprises a double-mast single-phase furnace connected to a three-mast three-phase furnace through water-cooling and gas suction systems, with at least one mast of the three-mast three-phase furnace, on which an electrode holder is fixed, being spaced at such a distance from the double-mast single-phase furnace which ensures the melting of an ingot into a common mold.

Such plant allows melting large-size slab ingots and features high versatility ensuring simultaneous melting of different ingots with each electrode holder serving its mold.

2 Claims, 4 Drawing Figures

ELECTROSLAG REMELTING PLANT

The present invention relates to ferrous metallurgy and more particularly to plants for the electroslag remelting of metals into ingots of different designation weight, including bimetallic ones.

Known in the art are single- and multi-mast electroslag remelting furnaces with the maste carrying at one end carriages with electrode holders for consumable electrodes and at the other end-carriages for mounting a mold. Arranged under the mold in each furnace is a base plate set up on the carriage.

Also known is a plant for producing ingots by electroslag remelting of metal (see, e.g., U.S. Pat. No. 3,587,715, Cl. 164-252, filed on Apr. 12, 1967), comprising two vertical masts. Mounted movably on each mast in its top portion are carriages on which are fixed electrode holders with consumable electrodes. The carriages are capable of turning about the mast axis which makes it possible to feed the consumable electrodes alternately into a single mold by making use of two electrode holders.

A disadvantage of the known plants resides in a limited number of electrodes per mold, through which it is impossible to provide a large surface of a melt that is needed for melting large-size slab ingots. Moreover, the prior-art setups fail to provide the melting of ingots according to "electrode-electrode" and "electrode-base plate" circuits without additional modification of electric circuitry, since the cuts have no current-carrying inserts that would allow arranging electrodes thereon according to one of the above outlined circuits.

It is an object of the present invention to overcome the above disadvantages.

Another object of the invention is the provision of an electroslag remelting plant which would make it possible to provide a large melt surface, that is needed to produce large-size slab and bimetallic ingots, and high versatility of the plant when melting ingots of other designation and weight.

This object is accomplished by providing an electroslag remelting plant, comprising a double-mast single-phase furnace with a water-cooling and a gas suction system, which plant, according to the present invention, includes an additional three-mast three-phase electroslag remelting furnace connected directly to the hydraulic cooling and gas suction system of the first furnace, with at least one of mast of said three-mast furnace, on which an electrode holder is fixed, being spaced at such a distance from the double-mast single-phase furnace which would ensure the melting of an ingot into a common mold.

Moreover, it is expedient that in each electrode holder, having two cuts, one of the cuts should accommodate current leads arranged for melting an ingot according to an "electrode-electrode" circuit and another one — a current lead for melting an ingot according to an "lectrode-base plate" circuit.

The herein-proposed plant for the electroslag remelting of metals allows attaining a novel, as compared with the known furnaces, favourable effect which consists in producing sound large-size slab and bimetallic ingots. It can be achieved since the plant of the invention affords the possibility of using a large number of electrodes for providing a requisite surface of the melt, a feature ensuring both the soundness of the ingot being melted and a high yield of the plant.

Moreover, in melting other ingots, such as, slab, forging-grade, hollow ingots and castings corresponding in shape to an article, the plant features high versatility that is attributable to the fact that each electrode holder can operate either individually serving its mold or in combination with other electrode holders, with the ingots being melted concurrently in each of the furnaces with each electrode melting into its mold.

The nature of the invention will be clear from the following detailed description of its particular embodiment to be had in conjunction with the accompanying drawings, in which.

Figure 1:
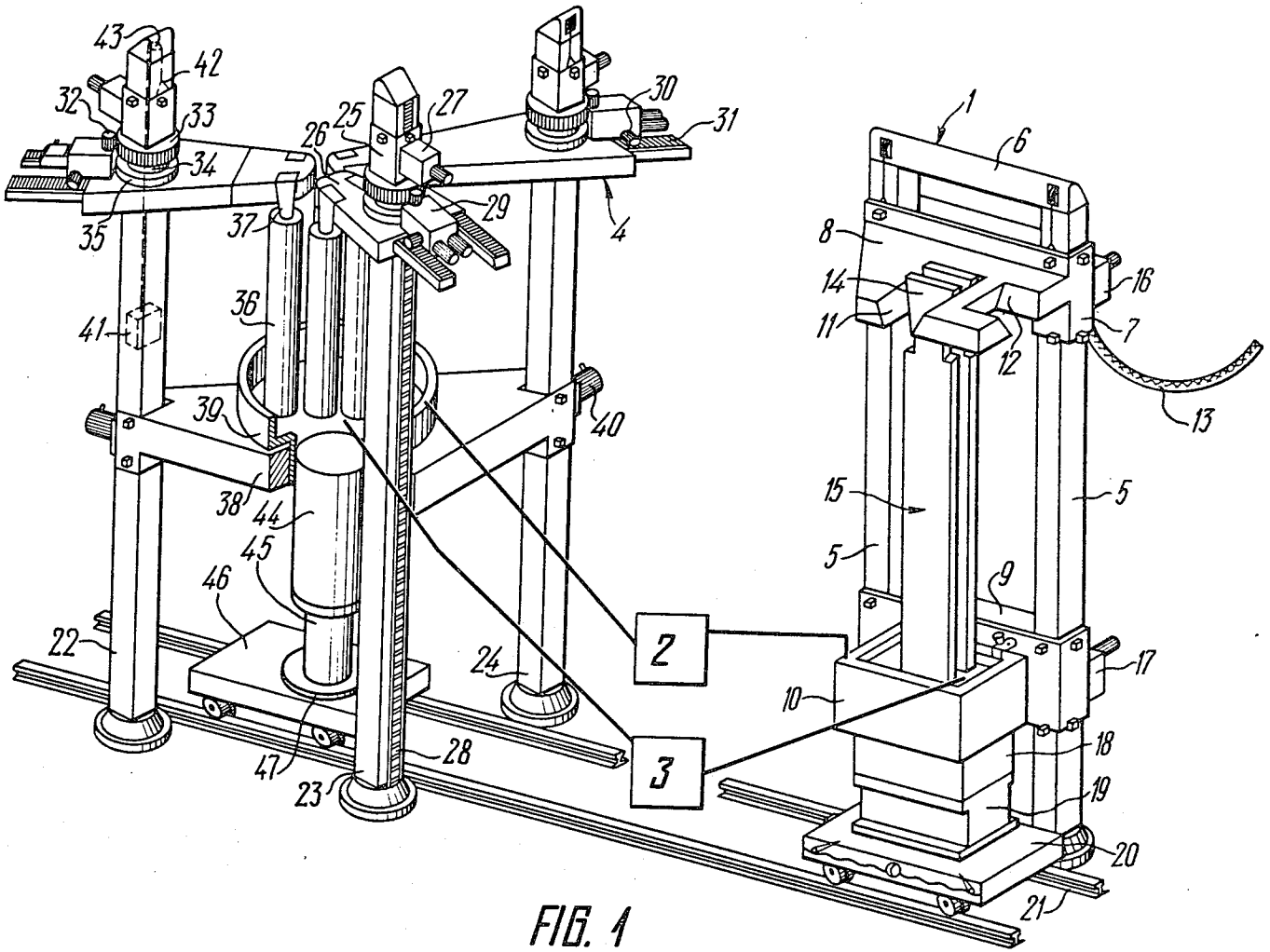
FIG. 1 shows a general view of an electroslag remelting plant.

An electroslag remelting plant (FIG. 1), comprising, according to the invention, two furnaces, of which the first one is a double-mast single-furnace 1 that is connected through a water-cooling system 2 and a gas suction system 3 to the second three-mast three-phase furnace 4.

The supporting structure of the double-mast single-phase furnace 1 (FIG. 1) is built up of two masts 5 interconnected in their top part by a girder 6. In the top portions of the masts 5 are mounted carriages 7 travelling vertically and carrying an electrode holder 8. Set up in the bottom portion of the mast 5 are carriages 9 with a mold 10. In the wedge-shaped electrode holder 8 at its end opposite to its attachment to the carriage 7 provision is made for two cuts 11 and 12 with the mating surfaces of current leads 13, in which are fixed standard heads 14 of electrodes 15.

The carriages 7 and 9 travel along the masts 5 with the aid of differential gear drives 16 and 17 ensuring their transfer with a working and a cruising speed.

The mold 10 serves for forming an ingot 18 disposed on a base plate 19 that is positioned on a carriage 20 travelling along a track 21.

The double-mast single-phase furnace 1 is connected to the three-mast three-phase furnace 4 with the help of the water-cooling system 2 and gas suction system 3.

The three-mast three-phase furnace 4 comprises three masts 22, 23 and 24, of which each mounts in its top portion a carriage 25. Fixed on each carriage 25 is an electrode holder 26 carried along each mast 22, 23 and 24 by a differential gear drive 27 whose gear interacts with a rack 28 secured to each mast 22, 23 and 24. The gear 27 enables the electrode holder 26 to transfer with a working and cruising speed. The electrode holder 26 is set up on the carriage 25 with a possibility of rotating radially with the aid of a turning drive 29 adapted also for moving the electrode holder in a horizontal plane with the help of a gear 30 interacting with a rack 31. Rotation of the electrode holder 26 about the axes of the masts 22, 23 and 24 is effected with the help of a gear 32 and a gear rim 33 rigidly connected to tires 34 and 35 mounted on each carriage 25.

Fixed in each electrode holder 26 at the end opposite to its attachment to the carriage 25 are electrodes 36 with V-shaped standard heads 37. All three masts 22, 23 and 24 are interconnected by a common crossarm 38 on which is disposed a mold 39. A crossarm 38 is furnished with a vertical transfer gear 40.

The masts 22, 23 and 24 house counterweights 41 connected with the aid of a rope 42 and pulleys 43 to the crossarm 38 to relieve the latter from its own weight. An ingot 44 formed in the mold 39 is positioned on a base plate 45. The base plate 45 is in its turn mounted on a carriage 46 travelling along a track 47.

Figure 2:
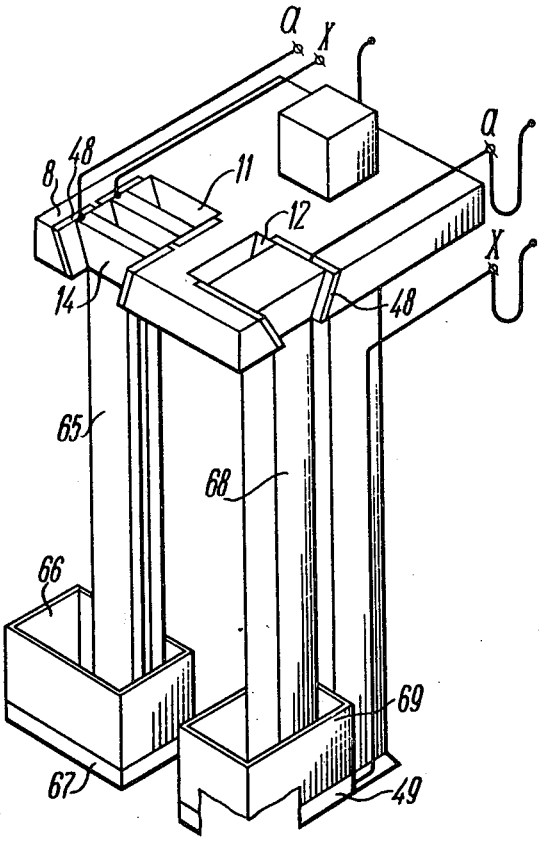
FIG. 2 depicts the layout of current leads in the electrode holder for different ingot melting circuits.

In the cuts of each of the electrode holers, e.g., in the cuts 11 and 12 of the electrode holder 8 (FIG. 2) are arranged current-carrying inserts 48 on which rest the standard heads 14 of the electrodes 15.

The cut 11 houses two standard heads 14 of the electrodes 15, of which each rests on its pair of the current-carrying inserts 48 set up in this cut, while the cut 12 accommodates one pair of the current-carrying inserts 48 supporting accordingly one standard head 14 of the electrode 15.

Connected to one of the pairs of the current-carrying inserts 48 in the cut 11 is phase *a* and to another pair — phase *x*, which allows melting as ingot according to an "electrode-electrode" circuit.

Arranged in the cut 12 is one pair of the current-carrying inserts 48 to which is connected phase *a*, phase *x* being connected to the base plate 40 which permits melting an ingot according to an "electrode-base plate" circuit.

The electroslag remelting plant is suitable for melting different ingots.

Figure 3:
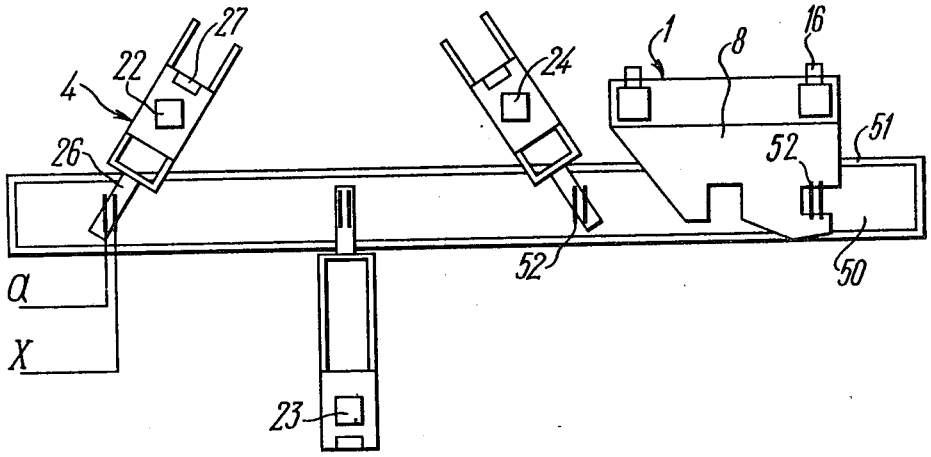
FIG. 3 shows diagrammatically the melting of large-size slab or bimetallic ingots on the proposed plant.

When the electroslag remelting plat is employed for melting large-size slab or slab bimetallic ingots 50 (FIG. 3) in a mold 51, electrodes 52 are set up in the electrode holder 8 of the double-mast furnace 1 and in each electrode holder 26 of the masts 22, 23 and 24 of the three-mast furnace 4.

Next the electrodes 52 are positioned with the aird of the electrode holders 26 in the mold 51 uniformly along the entire surface of an ingot being melted, which makes it possible to obtain a large surface of a metal melt that is needed for producing large-size slab ingots.

Phase *a* is connected to one of the electrodes 52 mounted in each electrode holders 8 and 26 and phase *x* to another electrode 52 set up in the same electrode holder, this ensuring the melting of an ingot according to the "electrode-electrode" circuit.

During the melting process the electrodes 52 are transferred by the differential gear drive 16 of the double-mast furnace 1 and by the differential gear drives 27 of the three-mast furnace 4. When remelting the electrodes 52 the electrode holders 8 and 26 travel with a working speed provided by their drives 16 and 27.

Upon melting the ingot 50, all the electrode holders 8 and 26 move upwards with a cruising speed and the ingot 50 together with the mold 51 is removed outside the plant.

Figure 4:
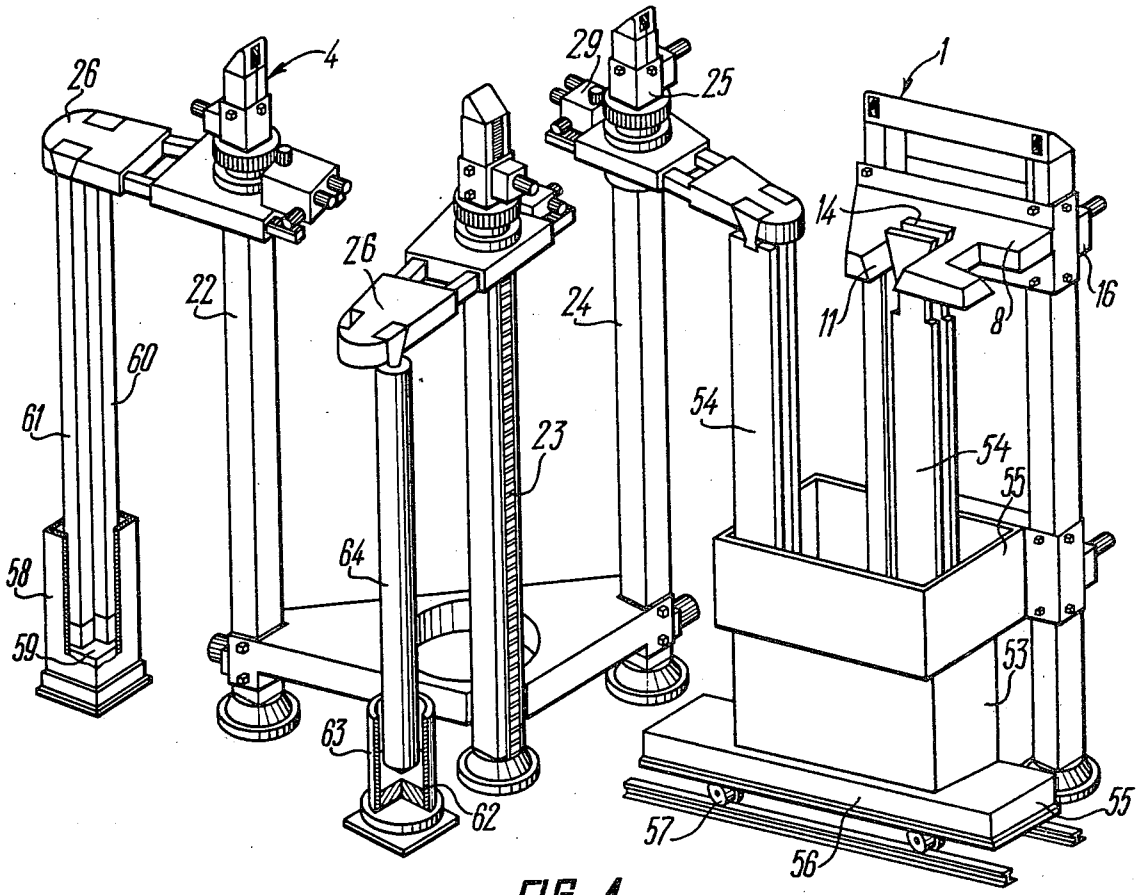
FIG. 4 shows the electroslag remelting plant with the electrode holder of the double-mast furnace and one electrode holder of the three-ast furnace melting an ingot into a common mold while the remaining two electrode holders of the three-ast furnace melt ingots individually into their mold.

When the herein-proposed plant is utilized for melting medium-size slab or slab bimetallic ingots 53 (FIG. 4), electrodes 54 are fixed in the electrode holder 8 of the double-mast furnace 1 with the aid of the standard heads 14.

To obtain the requisite surface of the melt in a mold 55 the electrode holder 26 is turned through a requisite angle by the turning drive 29 mounted on the mast 24 of the three-mast furnace 4. In the course of remelting the electrode 54 the electrode holders 8 and 26 are carried downwards by their drives 16 and 17 with a working speed. Upon melting the ingot 53, the electrode holders 8 and 26 are moved upwards with a cruising speed.

The ingot 53 that is left on a base plate 56 together with the mold 55 mounted on a carriage 57, is rolled off outside the plant.

Simultaneousl with the ingot 53 being formed, an ingot 59 is melting into a mold 58 by using electrodes 60 and 61 according to the "electrode-electrode" circuit. In this case the electrodes 60 and 61 are fixed in the electrode holder 26 mounted on the mast 22. At the same time an ingot 62 is melted in a mold 63 by using an electrode 64 according to the "electrode-base plate" circuit. The electrode 64 is fixed in the electrode holder 26 mounted on the mast 23 of the three-mast furnace 4. Upon melting the ingots 59 and 62 the electrode holders 26 set up on the masts 22 and 23 are carried upwards and the melted ingots are removed.

When melting heavy ingots the plant enables also concurrent individual operation of the double-mast furnace 1 (FIG. 1) and three-mast furnace 4.

In melting the ingot 18 in the double-mast furnace 1 according to the "electrode-electrode" circuit, the electrodes 15 are set up in the electrode holder 8 with the aid of the standard heads 14. In this case the electrode holder 8 is transferred by the differential gear drive 16 with a working speed towards the mold 10 that is fixed on the carriage 9 and is carried upwards by the drive 17.

On completion of the melting process the electrode holder 8 is moved upwards, the mold 10 being also carried upwards by the drive 17 of the carriage 9 to remove it from the ingot 18.

The melted ingots 18 which remained on the base plate 19 are removed with the help of the carriage 20 that is carried along the track 21.

When melting a heavy forging ingot 44 in the three-mast furnace, the electrode holders 26 are turned by the turning drives 29 and are arranged so that the electrodes 36 would be melted simultaneously into the common mold 39. In this case the melting is accomplished on the principle of opposite motion, with the mold 39, mounted on the cross-arm 38 with the halp of the drive 40, being moved towards the electrode holders 26 that are simultaneously transferred together with the electrodes 36 by the differential gear drives 27. In this case the ingot 44 can be melted either according to the "electrode-electrode" or "electrode-base plate" circuit. After the ingot 44 has been melted, the electrode holders 26 are carried upwards together with the crossarm 38 and mold 39, and the ingot 44 that is left on the base plate 45 set up on the carriage 46 is rolled off along the track 47 outside the furnace.

However, all the above-specified ingots can be melted either according to the "electrode-electrode" or "electrode-base plate" circuit.

When melting ingots according to the "electrode-electrode" circuit, electrodes 65 (FIG. 2) are mounted in the cut 11 on each pair of the current-carrying inserts. 48. In this case the electrodes 65 are remelted into a mold 66 mounted on a base plate 67.

In melting ingots according to the "electrode-base plate" circuit an electrode 68 is mounted in the cut 12 on the current-carrying inserts 48. In this case the electrode 68 are melted in a mold 68 mounted on the base plate 49.

Thus, the herein-proposed electroslag remelting plant allows melting large-size slab ingots ensuring a large melt surface, this being achieved by mounting an additional electroslag remelting furnace. The furnace comprises three masts, of which each mounts a swinging pull-out electrode holder. The electrode holders ensure a uniform distribution of the electrode in the mold over the entire surface of the ingot being melted.

Characteristic of the proposed plant is a high versatility which affords the possibility of melting concurrently any required ingots with each electrode holder serving its respective mold or by using a proper combination of the electrode holders serving a common mold, a feature ensuring a large yield.

Moreover, the herein-proposed plant provides also high mobility of the melting process with the electrodes being melted at various duties into different molds; it also makes it possible to melt ingots differing in weight and designation.

What we claim is:

1. An electroslag remelting plant, comprising molds with a base plate; a double-mast single-phase furnace with a water-cooling and a gas suction system; electrode holders arranged on each of said masts; a three-mast three-phase electroslag remelting furnace connected directly to said water-cooling and gas suction systems of the double-mast single-phase furnace; at least one of the masts of said three-mast three-phase furnace on which the electrode holder is fixed is arranged at such a distance from the double-mast single-phase furnace which ensures the melting of an ingot into a common mold.

2. A plant of claim 1, wherein in each of said electrode holders having two cuts one of the cuts accommodated current leads arranged for melting an ingot according to an "electrode-electrode" circuit and another cut — for melting an ingot according to an "electrode-base plate" circuit.

* * * * *